United States Patent [19]

Kidd

[11] Patent Number: 5,031,686

[45] **Date of Patent: * Jul. 16, 1991**

[54] METHOD FOR CASTING METAL ALLOYS WITH LOW MELTING TEMPERATURES

[75] Inventor: Thomas F. Kidd, Toledo, Ohio

[73] Assignee: Electrovert Ltd., Quebec, Canada

[ * ] Notice: The portion of the term of this patent subsequent to Sep. 25, 2007 has been disclaimed.

[21] Appl. No.: 562,710

[22] Filed: Aug. 3, 1990

Related U.S. Application Data

[63] Continuation-in-part of Ser. No. 268,492, Nov. 8, 1988, Pat. No. 4,958,675.

[51] Int. Cl.[5] ..... B22D 17/00

[52] U.S. Cl. ..... 164/120; 164/316

[58] Field of Search ..... 164/113, 120, 133, 304, 164/314, 316

[56] References Cited

U.S. PATENT DOCUMENTS

| | | | |
|---|---|---|---|
| 2,621,365 | 12/1952 | Deschamps | 164/316 |
| 3,209,419 | 10/1965 | Deguchi et al. | 164/113 |
| 4,261,414 | 4/1981 | Frenette et al. | 164/316 |
| 4,471,829 | 9/1984 | Perrella et al. | 164/113 |
| 4,676,296 | 6/1987 | Pascoe et al. | 164/303 |
| 4,958,675 | 9/1990 | Kidd | 164/120 |

*Primary Examiner*—Richard K. Seidel
*Assistant Examiner*—Edward A. Brown
*Attorney, Agent, or Firm*—Darby & Darby

[57] ABSTRACT

A metal casting process for producing melt-out metal cores and the like made of metal alloys with low melting temperatures achieves a casting with uniform density, high quality finish and a fine grain structure. The process and apparatus do not require the pre-pressurization of a charging cylinder and permit closed dies to be used. The apparatus comprises a molten metal alloy tank, a cylinder in the tank having at its base a connection to a passageway leading through the tank to a die located outside the tank. A valve is provided in the passageway, located in the tank having a first position where the passageway to the die is open and a second position where the passageway to the die is closed. In the second position, a valve port provides a connection from the cylinder to the molten metal alloy in the tank. A valve actuator moves the valve from the first to the second position, a piston within the cylinder and a power system raises the piston in the cylinder with the valve in the second position to fill the cylinder with molten metal alloy and lower the piston with the valve in the first position to inject molted metal into the die. In a preferred embodiment, a second valve is located outside the tank and in the passageway to the die. The second valve operates in conjunction with the first valve in the first position to allow the injection of molten metal alloy into the die.

5 Claims, 3 Drawing Sheets

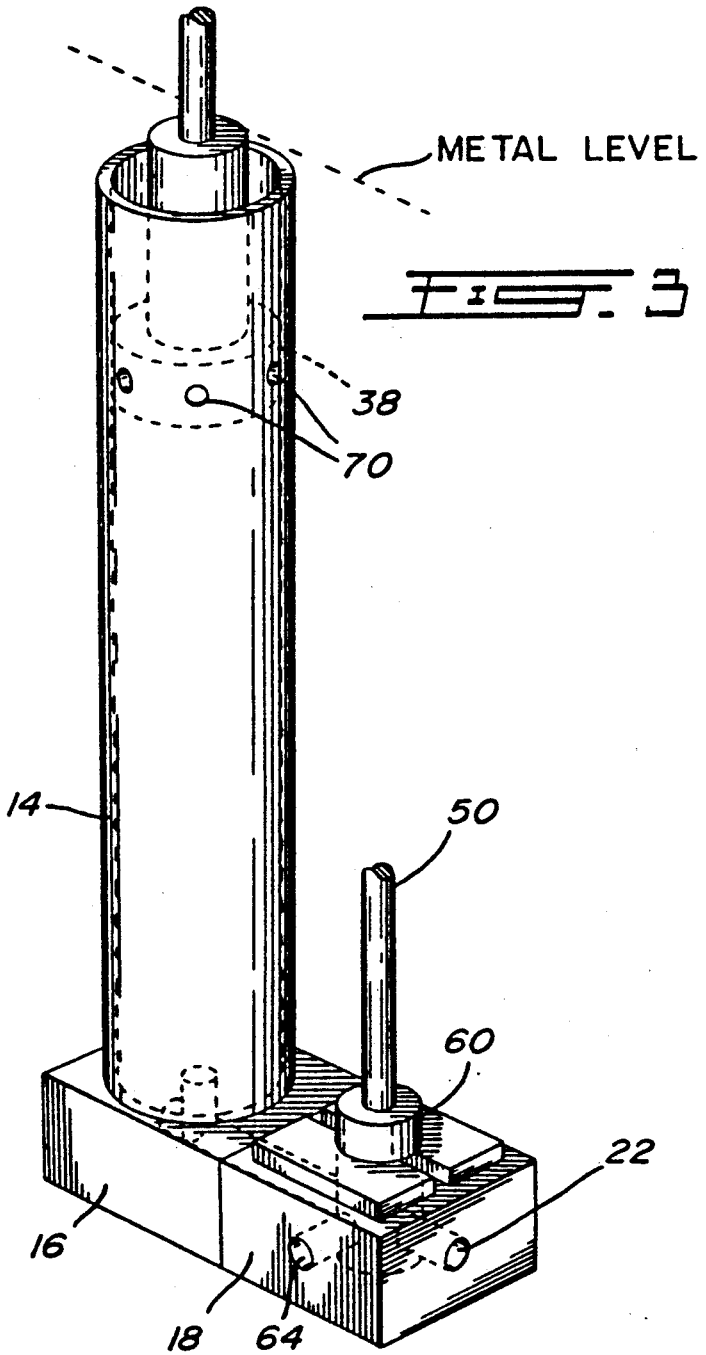
FIG. 3
FIG. 4
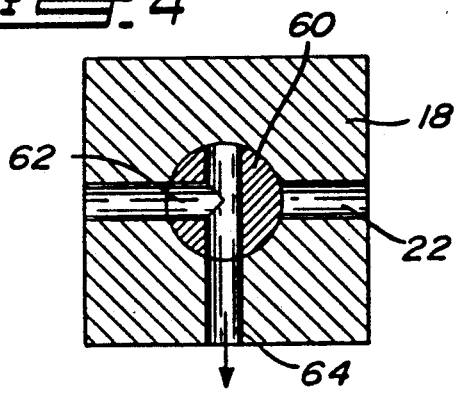
FIG. 5
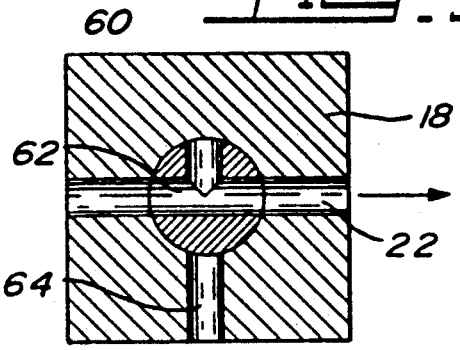

METHOD FOR CASTING METAL ALLOYS WITH LOW MELTING TEMPERATURES

This application is a continuation in part of U.S. patent application Ser. No. 268,492 filed Nov. 8, 1988, now U.S. Pat. No. 4,958,675.

The present invention relates to a metal casting process to produce melt-out metal cores for subsequent molding in components made of plastics material. More specifically, the present invention relates to a method and apparatus for casting metal alloys with low melting temperatures to achieve a product with uniform density and a fine grained structure.

BACKGROUND OF THE INVENTION

Melt-out metal parts of complex shapes are made for use as cores in subsequently molded plastic components. Such cores are made of a low melting temperature alloy and are removed from the plastics components by melting the core and leaving the components. In another embodiment, metal alloys with low melting temperatures are used for encapsulating components such as turbine blades so they may be held for machining and other finishing steps. After use, the metal from the cores or encapsulations is re-melted and re-used. One example of an apparatus for casting metal alloys with low melting temperatures is disclosed in U.S. Pat. No. 4,676,296.

SUMMARY OF THE INVENTION

In the apparatus depicted in this patent, a cylinder is provided in a tank of liquid metal alloy with a passage from the bottom of the cylinder passing out through the tank and into a mold or die. A valve is provided in the passage to shut off the flow of molten metal alloy in between injection cycles. A piston moves up and down within the cylinder and the cylinder is filled by raising the piston up above a filler aperture in the top of the cylinder to allow liquid metal alloy to flow into the cylinder. Before commencing the injection step, the piston is moved downwards a predetermined amount so that the liquid metal alloy within the cylinder is pre-pressurized. After the pre-pressurization step, the valve in the passage to the die is opened to permit liquid metal alloy to be injected into the die.

The present invention provides a valve in the passage or transfer line from the bottom of the cylinder to the mold or die which is located in the metal alloy tank and has a port when the valve is in the closed position that closes the transfer line to the die, but opens up a connection from the cylinder to the liquid metal alloy in the tank. This permits molten metal alloy to be drawn into the cylinder through the port when the valve is in the closed position and the piston is raised. It also enables the piston within the cylinder to be reciprocated several times with the valve closed, thus permitting a change and recirculation of the liquid metal alloy within the cylinder with the liquid metal alloy in the tank.

With this additional port on the valve within the metal alloy tank, the present invention avoids the necessity of pre-pressurizing metal alloy in the cylinder prior to injection into a mold or die. It also permits the injection step to be carried out without having to have a stop limit switch or other control and permits use of a closed die rather than an open die, so that the die provides the volume control and no predetermined volume control is required. Furthermore, by maintaining pressure on the liquid metal alloy in the die during cooling, a casting with uniform density and a fine grain structure is achieved.

A further improvement in the present invention is that no extra pressure is required on the return stroke when the piston is being raised, as in the case when no port within the tank is provided, because on the return stroke, liquid metal alloy is pulled through the port to enter the cylinder.

The forming of melt-out metal parts is a different operation to die casting wherein metals having higher melting temperatures, generally above 350° C. are injected into a die at high pressures. In die casting shot pressures are generally in the range of 800 to 4000 lbs/in$^2$ (562 to 2809 kPa), and the time for injection is in the order of 30 to 40 milliseconds. In such an operation where hot metals are injected at a high velocity and turbulent flow into a die through a narrow gate, air can become entrapped and pressures build up in the cylinder and passage to the die. These high speed injection processes generally include runners leading into the die, and the unsolidified metal drains back after the casting process.

Melt-out metal parts must be made out of metals that melt below the temperatures of the plastic. Such metals do not lend themselves to high pressure die casting. They are cast at pressure generally in the range of 30 to 50 lbs/in$^2$ (21 to 35 kPa). At higher pressures and faster injection speeds, porous castings can be formed with these metals. In the casting of melt-out metal parts, the metal is not placed under high pressure but allowed to flow into the die, the filling time can vary from about 3 to 30 seconds depending on the size of the metal part. When the die is full of metal, a build up of pressure occurs, generally in the order of 30 to 40 lbs/in$^2$ (21 to 28 kPa) and is maintained for about 1 to 10 seconds, again depending on the size of the metal part. Drain back of molten metal does not need to occur, because the dies are direct cavity injection and do not have runners.

It has been found that in addition to the process of the present invention being repeatable, the castings, being cores or other components made of metal alloys with low melting points, have an improved surface finish and a uniform dense fine grained structure over that produced by die casting methods.

The present invention provides a method of producing a casting or encapsulation from a molten metal alloy or the like having a melting point below about 350° C., including an injection cylinder having an injection piston therein, and means to raise and lower the piston in the cylinder, the injection cylinder having an injection passageway containing molten metal alloy, containing molten metal alloy, passing through a molten metal alloy tank to inject molten metal alloy from the tank into a die, the improvement comprising the steps of: closing the passageway from the injector cylinder to the die, filling the injection cylinder with molten metal alloy from the tank through a valve port located in the injection passageway at an elevation lower than the injection cylinder, by raising the piston in the cylinder, closing the valve port in the injection passageway and opening the passageway from the injection cylinder to the die, lowering the piston in the cylinder after the passageway is open so no prepressurization occurs in the cylinder or passageway prior to injection, the piston being lowered at a controlled rate so that substantially no pressure resulting from lowering of the piston occurs in the die during injection, and the die is filled within a time of about 3 to 30 seconds, and applying pressure to the piston after the injection step to pressurize the molten metal alloy in the die during solidification of the casting.

The present invention also provides an apparatus for producing a casting or encapsulation from a molten metal alloy or the like having a melting point below about 350° C., comprising a tank adapted to contain molten metal alloy, a cylinder located in the tank having at its base a connection to an injection passageway adapted to contain molten metal alloy, leading through the tank to a die located outside the tank, a valve in the passageway located in the tank having a first position where the passageway to the die is open and a second position where the passageway to the die is closed, the connection from the cylinder leading via a valve port opening located in the injection passageway at an elevation lower than the cylinder to the tank, valve operating means to transfer from the first position to the second position, a piston within the cylinder, means to raise the piston in the cylinder with the valve in the second position to fill the cylinder with molten metal alloy and means to lower the piston in the cylinder with the valve in the first position to ensure no prepressurization of the molten metal occurs in the cylinder or the passageway, and to inject molten metal alloy into the die, control means for the means to raise and lower the piston in the cylinder to control the flow rate of molten metal alloy injected into the die so that the die fills within a time of about 3 to 30 seconds, and means to maintain pressure on the piston after the molten metal alloy has been injected into the die during solidification of the casting.

BRIEF DESCRIPTION OF THE DRAWINGS

In drawings which illustrate embodiments of the invention:

FIG. 3 is an isometric view of a cylinder and valve for placing within a molten metal alloy tank;

FIG. 4 is a top cross sectional detailed view showing the rotary plug of the valve in the closed position;

FIG. 5 is a top detailed sectional view of the valve shown in FIG. 4 in the open position.

DETAILED DESCRIPTION OF THE PREFERRED EMBODIMENTS

Low melting temperature metal alloys having a melting temperature in the range of about 30° C. to 350° C. are used for making castings for cores or ecapsulation. Examples of these metal alloys are tin, antimony and lead alloys, and eutectic alloys of bismuth and tin.

Figure 1:
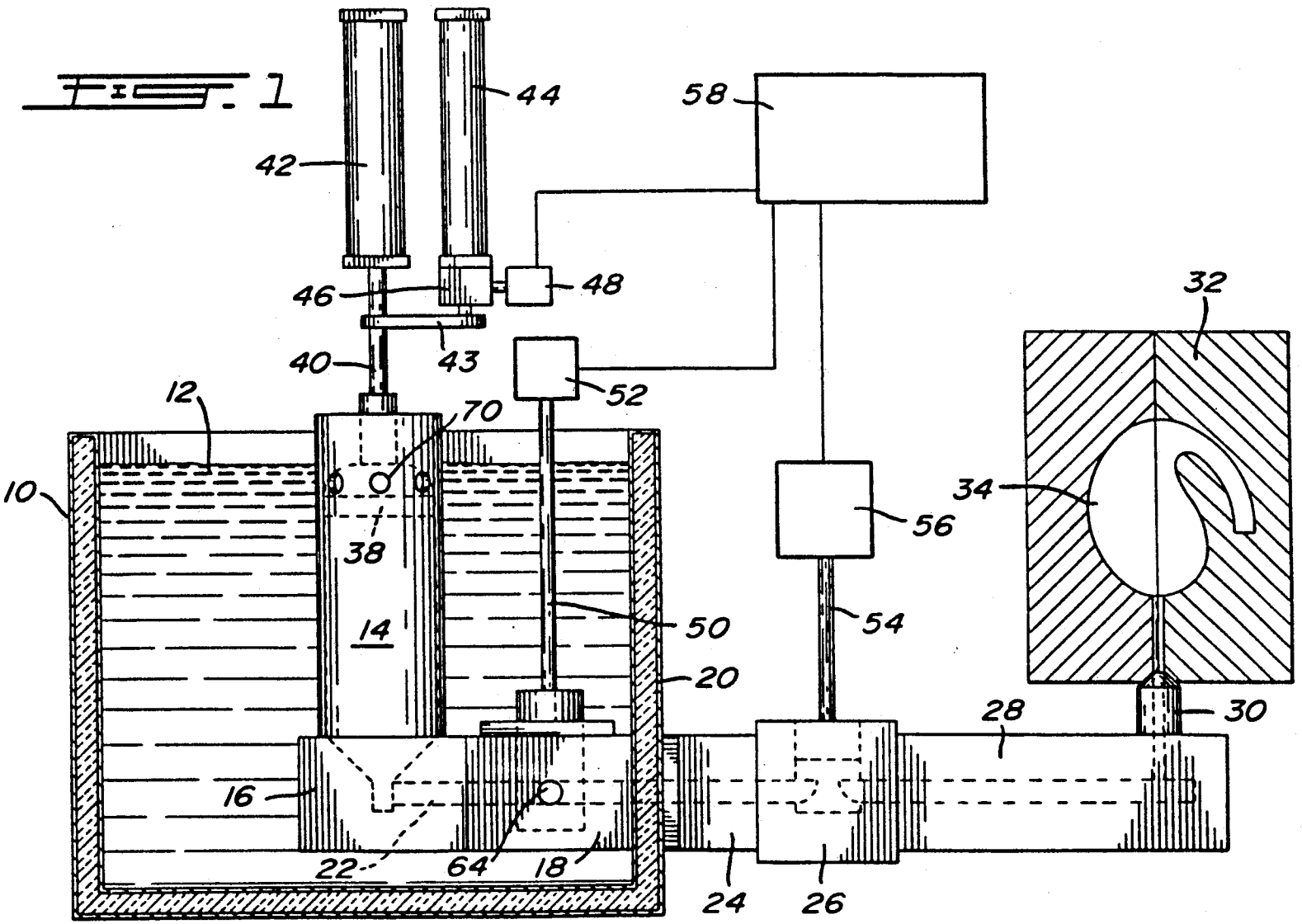
FIG. 1 is a schematic diagram depicting one embodiment of the apparatus for producing a casting from a molten metal alloy.

FIG. 1 illustrates a tank 10 filled with molten metal alloy 12 and having an injection cylinder 14 vertically positioned therein, mounted on an injection block 16. The injection block 16 is joined to a safety valve body 18 which in turn is attached to the wall 20 of the tank 10. A connecting passageway 22 extends from the injection cylinder block 16 where it is joined to the cylinder 14 through the safety valve body 18 and the wall 20 of the tank 10 into a standoff block 24 which is attached to a rotary single lock valve body 26 in turn attached to a manifold 28. A nozzle 30 on the manifold 28 extends vertically upwards and joins a die 32 which is a closed die and may be removable from the nozzle 30 for separation and removal of the casting 34 within the die 32.

Figure 2:
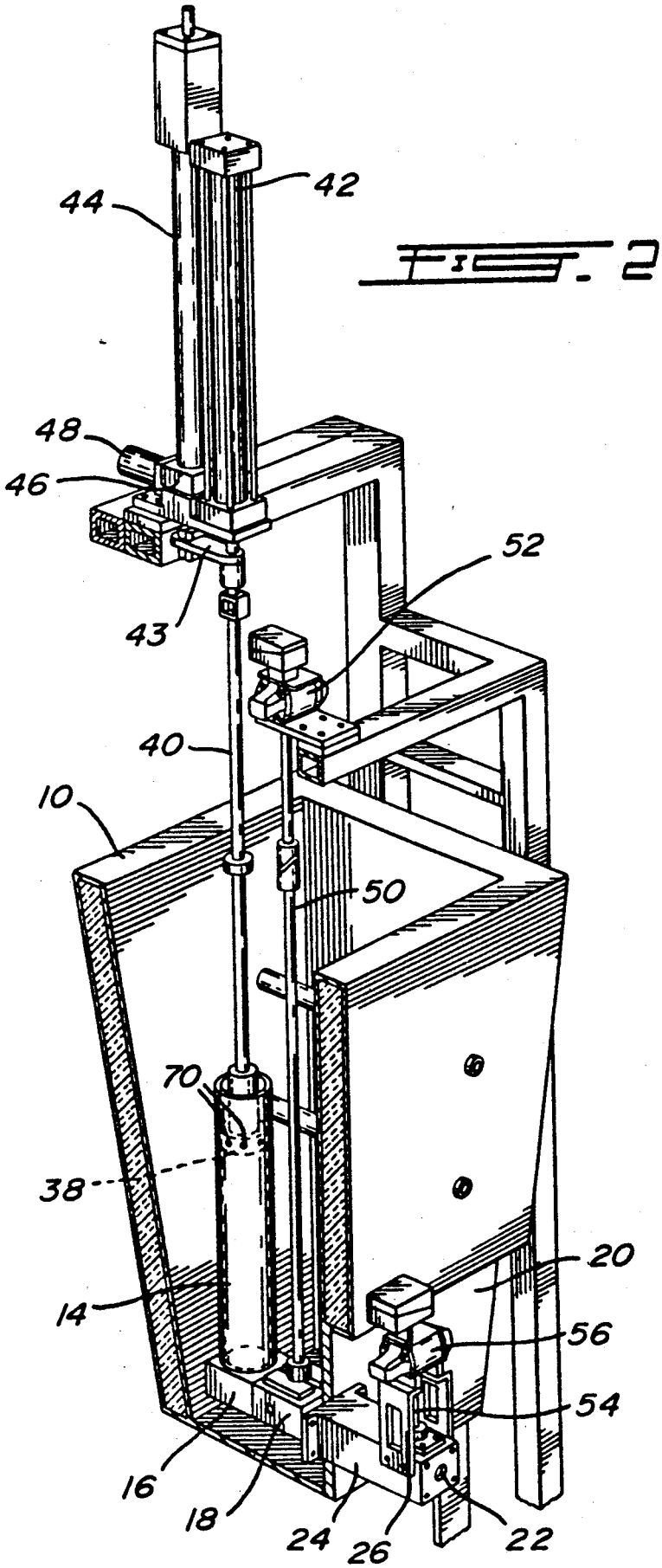
FIG. 2 is an isometric view, partially in section, of a molten metal alloy tank with a cylinder and valve within the tank.

As shown in FIG. 2, the injection cylinder 14 has an injection piston 38 on a shaft 40 which moves up and down within the cylinder 14. The piston 38 is powered by a pneumatic cylinder 42 which is double acting and has adjacent to it and joined by a bridge piece 43, a hydraulic cylinder 44 with a hydraulic valve 46 which has a stepper motor 48 to open and close the hydraulic valve 46 and thus effect speed control of the injecting piston 38. The air cylinder 42 is double acting, thus powers the piston 38 both upwards and downwards. The speed control is set by the stepper motor 48. The operation of the safety valve 18 is by a rotary shaft 50 extending up above the level of the molten metal alloy 12 in the tank 10 to a rotary actuator 52. Similarly, the rotary single lock valve 26 is activated by a shaft 54 connected to a rotary actuator 56. A micro-processor 58 as illustrated in FIG. 1 operates the pneumatic cylinder 42, controls the speed of the piston 38 in the cylinder 14 by the stepper motor 48 and drives the rotary actuators 52 and 56 to control the sequential steps of the casting process. Whereas one arrangement to control the movement of the piston is disclosed herein, other systems including a controlled hydraulic cylinder and mechanical means with electronic control may be used.

FIG. 3 illustrates the safety valve 18 and injection cylinder block 16. A plug 60 in the valve block 18 is rotated by the actuator shaft 50 to provide a three port two position valve. As shown in FIGS. 4 and 5, the plug 60 has a T-shaped port 62 which when in the closed position connects to a valve body port 64 which is within the tank 10, thus in the closed position as shown in FIG. 4, the cylinder 14 by means of the connecting passage 22 is connected to the valve body port 64 and when the piston 38 is raised in the cylinder 14, liquid metal alloy is pulled into the cylinder through the port 64 and the passageway 22. When the piston has reached its maximum height, which may be set by a limit switch (not shown), then the safety valve opens to the configuration shown in FIG. 5 and the passageway 22 is open from the cylinder 14 to the die 32. Thus as the piston 38 moves downwards, molten alloy flows through the passageway 22. Because the die 32 is a closed rather than an open die, when it fills up, there is no space for the molten metal alloy to go, and, therefore, it is maintained under pressure within the system by the piston 38 which is pushed down by the pneumatic cylinder 42. By maintaining the pressure on the piston 30 and thus within the die 32, the metal is allowed to cool and solidify under pressure ensuring that no voids remain in the casting 34.

In one embodiment the filling time for the die 32 is in the range of about 3 to 30 seconds, depending upon the size of the metal part. When the die 32 is full, pressure builds up to about 30 to 50 lbs/in$^2$ (21 to 35 kPa) and the pressure is maintained for about 1 to 10 seconds.

Top ports 70 are provided at the top of the cylinder 14, thus if it is desired to drain the molten metal alloy from the tank 10, it is merely necessary to raise the piston 38 above the top ports 70, and open the valve body port 64 in the safety valve block 18. A drain valve (not shown) is provided at the bottom of the tank, and when opened, the liquid level goes down in both the tank and the cylinder at the same time. Furthermore, the liquid metal alloy within the cylinder may be changed from time to time by merely reciprocating the piston 38 in the cylinder 14 with the valve port 64 open so that the liquid metal alloy flows in and out as the piston 70 reciprocates.

There is substantially no pressure in the injection cylinder prior to the injection cycle and when the safety valve 18 opens and the rotary single lock valve 26 opens, the liquid metal alloy flows into the mold controlled by the speed of the piston 70 which in turn is controlled by the stepper motor 48 to the valve 46 in the hydraulic cylinder 44. The mold or die 32 is closed but air vents prevent pressure build up within the mold during the injection step. When the mold is completely full, pressure builds up and the liquid metal is held under pressure during solidification as the piston 38 is pushed downwards in the cylinder 14. The lock valve 26 closes and the safety valve 18 closes. The injection piston 38 is then raised up in the cylinder 14 allowing re-filling of the injection cylinder 14 with molten metal alloy through the port 64 in the safety valve block 18. The re-filling of the cylinder 14 occurs partly by gravity from the weight of liquid metal alloy in the tank 10 and partly by a vacuum occurring by raising the piston 38 in the cylinder 14.

The safety valve 18 shown herein incorporates a rotating plug 60 within a cylindrical aperture of the safety valve body 18. The rotating plug 60 provides less leakage and less wear than a reciprocating spool type valve, and performs well at low pressures. The lock valve 26 in one embodiment is of the type including a rotating member having a flat surface that rotates on a polished flat surface of a stationary disc. The safety valve 18 may be a similar type of valve as the lock valve 26 with an additional port provided so that when the valve is in the closed position, a port in the side wall connects the passageway 22 leading to the cylinder 14 to the liquid metal alloy in the tank 10.

Liquid metal flow rates delivering metal alloy to a die vary from about 0.1 to 1 Kg/sec. The tank 10 maintains the liquid metal alloy therein at the desired temperature, and heaters may be provided in the passageway and lock valve outside the tank as well as in the die to ensure the metal alloys are kept above the melting temperature and flow easily into the dies.

Various changes may be made to the embodiments described herein without departing from the scope of the present invention which is limited only by the following claims. Whereas one cylinder 14 is shown within the tank, several cylinders each having their own passageway to separate dies may be used.

I claim:

1. A method of producing a casting or encapsulation from a molten metal alloy having a melting point below about 350° C., including an injection cylinder having an injection piston therein, and means to raise and lower the piston in the cylinder, the injection cylinder having an injection passageway containing molten metal alloy, passing through a molten metal alloy tank to inject molten metal alloy from the tank into a die, the improvement comprising the steps of:

closing the passageway from the injection cylinder to the die;

filling the injection cylinder with molten metal alloy from the tank through an opened valve port located in the injection passageway at an elevation lower than the injection cylinder, by raising the piston in the cylinder;

closing the valve port in the injection passageway and opening the passageway from the injection cylinder to the die, lowering the piston in the cylinder after the passageway from the injection cylinder to the die is open so no prepressurization occurs in the cylinder or passageway prior to injection, the piston being lowered at a controlled rate so that substantially no pressure resulting from lowering of the piston occurs in the die during injection, and the die is filled within a time of about 3 to 30 seconds, and applying pressure to the piston after the injection step to pressurize the molten metal alloy in the die during solidification of the casting.

2. The method of producing a casting or encapsulation according to claim 1 wherein the pressure applied to the injection piston is in the range of about 21 to 28 kPa.

3. The method of producing a casting or encapsulation according to claim 1 wherein the pressure is applied to the injection piston for about 1 to 10 seconds.

4. The method of producing a casting or encapsulation according to claim 1 wherein the cylinder is placed within the molten metal tank, and filling of the injection cylinder is assisted by gravity when the valve port is open and the injection piston raised.

5. The method of producing a casting or encapsulation according to claim 1 including the addition of a rotary lock valve in the passageway outside the molten metal alloy tank adjacent the die, and wherein the rotary lock valve is closed during the filling step.

* * * * *

UNITED STATES PATENT AND TRADEMARK OFFICE

CERTIFICATE OF CORRECTION

PATENT NO. : 5,031,686

DATED : July 16, 1991

INVENTOR(S) : Thomas F. Kidd

It is certified that error appears in the above-identified patent and that said Letters Patent is hereby corrected as shown below:

Column 2, line 14, "562 to 2809" should read --5,516 to 27,580--.

Column 2, line 27, column 4, line 56, each occurrence, "21 to 35" should read --207 to 345--.

Column 2, lines 34-35 and claim 2, line 3, each occurrence, "21 to 28" should read --207 to 276--.

Signed and Sealed this

Second Day of March, 1993

*Attest:*

STEPHEN G. KUNIN

*Attesting Officer*

*Acting Commissioner of Patents and Trademarks*